United States Patent [19]

Stoll

[11] Patent Number: 4,682,727

[45] Date of Patent: Jul. 28, 1987

[54] UTILITY TOTE CONTAINER

[75] Inventor: Mark S. Stoll, Deephaven, Minn.

[73] Assignee: Liberty Diversified Industries, Inc., Minneapolis, Minn.

[21] Appl. No.: 836,059

[22] Filed: Mar. 4, 1986

[51] Int. Cl.[4] ..... B65D 5/30

[52] U.S. Cl. ..... 229/915; 229/171; 229/DIG. 11; 206/503; 206/515

[58] Field of Search ..... 229/915, 916, 917, 166, 229/52 AM, 52 AW, 126, 44 R, DIG. 11, 171, 190; 206/503, 505–508, 513, 515, 518, 519

[56] References Cited

U.S. PATENT DOCUMENTS

| | | | |
|---|---|---|---|
| 2,979,250 | 4/1961 | Hobbs | 229/DIG. 11 |
| 3,536,249 | 10/1968 | Houston | 229/171 |
| 3,899,121 | 8/1975 | Herbetko | 229/915 |
| 3,935,990 | 2/1976 | Crane | 229/915 |
| 3,964,607 | 6/1976 | Wagner | 206/503 |
| 4,119,265 | 10/1978 | Dlugoporski | 229/171 |
| 4,537,344 | 8/1985 | Thomas | 229/915 |

*Primary Examiner*—Willis Little
*Attorney, Agent, or Firm*—Moore & Hansen

[57] ABSTRACT

A portable, open top utility tote container constructed and shaped from a lightweight yet durable, semirigid, corrugated plastic material used to store or transport an unlimited variety of household or industrial items. The receptacle portion of the container is formed from a single sheet of material, cut, scored into panels, and folded to the shape of a tapered rectangular box. End panels and side flaps are folded over a reinforcing rim which runs around the top perimeter of the container, the end panels being cut out to form hand grips at opposing ends of the container, and the side flaps creating a firm stacking shoulder upon which the container may rest when stacked on other similar containers. The single sheet of material from which the receptable is formed, when extended in a single plane, has a configuration confined by a rectangle whose length and width are the distances between the outer edges of the end panels and side flaps.

7 Claims, 8 Drawing Figures

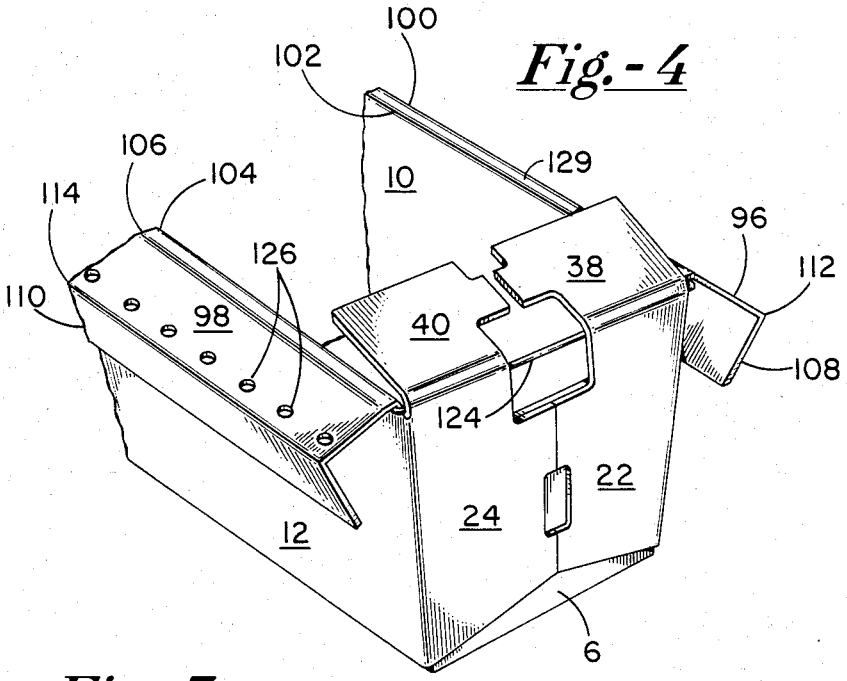
Fig.-4
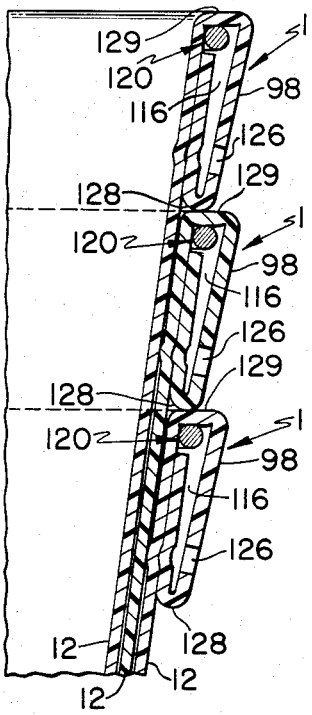
Fig.-8
Fig.-7
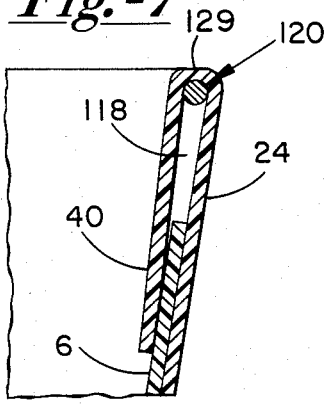
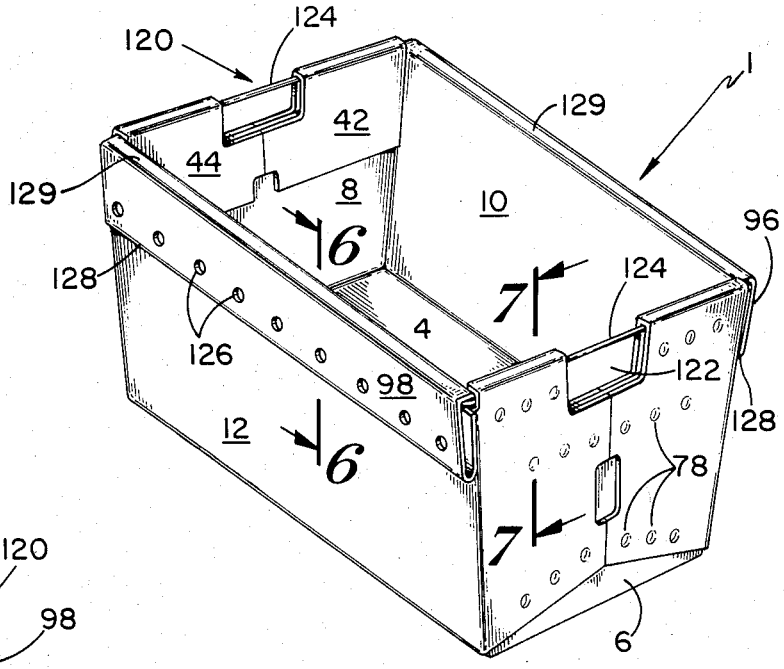
Fig.-5
Fig.-6
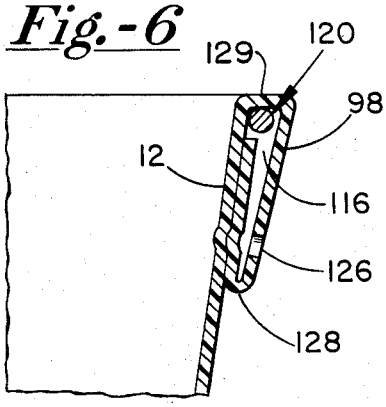

UTILITY TOTE CONTAINER

BACKGROUND OF THE INVENTION

Utility tote containers have traditionally been used for a variety of applications such as mail collection, grocery boxing, and storage or transportation of household and industrial items. These tote containers have been constructed from several type of materials, including cardboard, fiberboard, and corrugated plastic.

The container disclosed in Liberty Diversified Incorporated's U.S. Pat. No. 3,982,690 was designed for the special purpose of mail collection and use in conjunction with U.S. Postal Service collection boxes—hence the tote container's distinctive slant-top appearance. Though useful for mail collection, this tote suffers from several drawbacks, predominantly the susceptibility of fiberboard to moisture and chemical stains, and the need to mold and insert a separate base tray portion. A second flaw in this container is the great quantity of material necessarily consumed in making each box. Because of the arc-like configuration of the unfolded container, the containers must be laid out on the blank sheet so as to minimize waste, which is difficult since the original material takes on a rectangular shape when rolled out and an intricate pattern of several cutting dies would be necessary to minimize the amount of unused material.

Cardboard tote containers suffer the similar flaw of lacking any resistance to water or chemical penetration, and cannot support heavy loads.

Containers formed from corrugated plastic are also known. These containers are more desirable because of their strength, durability, and resistance to moisture, chemicals, dirt, and grime. However, such containers are relatively expensive to produce and an ongoing problem has been to find ways to minimize the amount of plastic material utilized without jeopardizing the container's structural integrity. The strength of a container is directly related to the number and size of the overlapping panels, which affect how securely the container may be fastened together. Another consideration is designing the container so that the base is formed by a single panel, which increases the container's load bearing capacity.

The present invention presents a corrugated plastic utility tote that may be formed from a single rectangular sheet of material, increasing the overlapping panel area used for securing the container and incorporating a stacking shoulder for nesting several containers within each other, the entire container consuming significantly less material than prior art designs.

BRIEF SUMMARY OF THE INVENTION

The utility tote container of this invention is particularly characterized by its economical one-piece construction, light weight, durability, and distinctive functional shape which render it a preferred design for a stackable container of comparable volume.

Designed to be conveniently stacked when not in use, the utility tote container is constructed from a lightweight yet extraordinarily durable corrugated polyethylene which makes it resistant to moisture, mildew, chemicals, stains, dirt, and grime so that it may be used to store or transport an unlimited variety of household or industrial items.

The utility tote container is advantageously formed from a single sheet of semi-rigid plastic material which may be cut, scored into panels, and folded into a tapered receptacle with a volume comparable to prior art utility totes, but using up to twenty five percent (25%) less material than the prior art utility totes. This economy is due to a combination of the unique manner by which the panels in the single sheet of material are layed out so as not to exceed the bounds of a rectangle formed by the outer edges of its panels, and the innovative method of folding those panels together to form the assembled utility tote container.

An additional advantage is, that in addition to consuming less material for a particular internal volume, the utility tote of this invention provides more overlapping surface area between the panels, thereby increasing the bonding area to afford greater strength and durability in the tote container.

An additional benefit of this utility tote lies in the construction of the side rim flaps. By double-folding the material and sonicly welding the lower edge of the rim flaps to the side wall of the container through access apertures in the outer rim flaps, the rim flaps are more securely fastened to the container, thus making it more difficult to pull loose when the container is rested upon or lifted by this rim.

The benefit of a stacking shoulder is further outlined in this invention. By using double score-lines in defining the top of the side flaps, a horizontal surface for the upper stacking shoulder is created. When containers are nested within each other, the upper stacking shoulder of one container is wider than the lower stacking shoulder of the container resting upon it. This provides for a more stable purchase as the top container is loaded, and permits containers to be easily lifted off lower containers without sticking together.

BRIEF DESCRIPTION OF THE DRAWINGS

FIG. 4 is a perspective view of the right end portion of the container with the right end wall, front and back sides, and right front and back foldover flaps folded to their upright position, and front and back inner and outer side flaps partially folded down;

FIG. 5 is a perspective view of the folded container of this invention;

FIG. 6 is a cross sectional view of the side rim flaps and side rim pocket taken through line 6—6 of FIG. 5;

FIG. 7 is a cross sectional view of the end rim pocket taken through line 7—7 of FIG. 5.

FIG. 8 is a cross sectional view of several nested containers showing how the lower stacking shoulder of one container rests on the upper stacking shoulder of the container below.

DESCRIPTION OF THE PREFERRED EMBODIMENT

Figure 1:
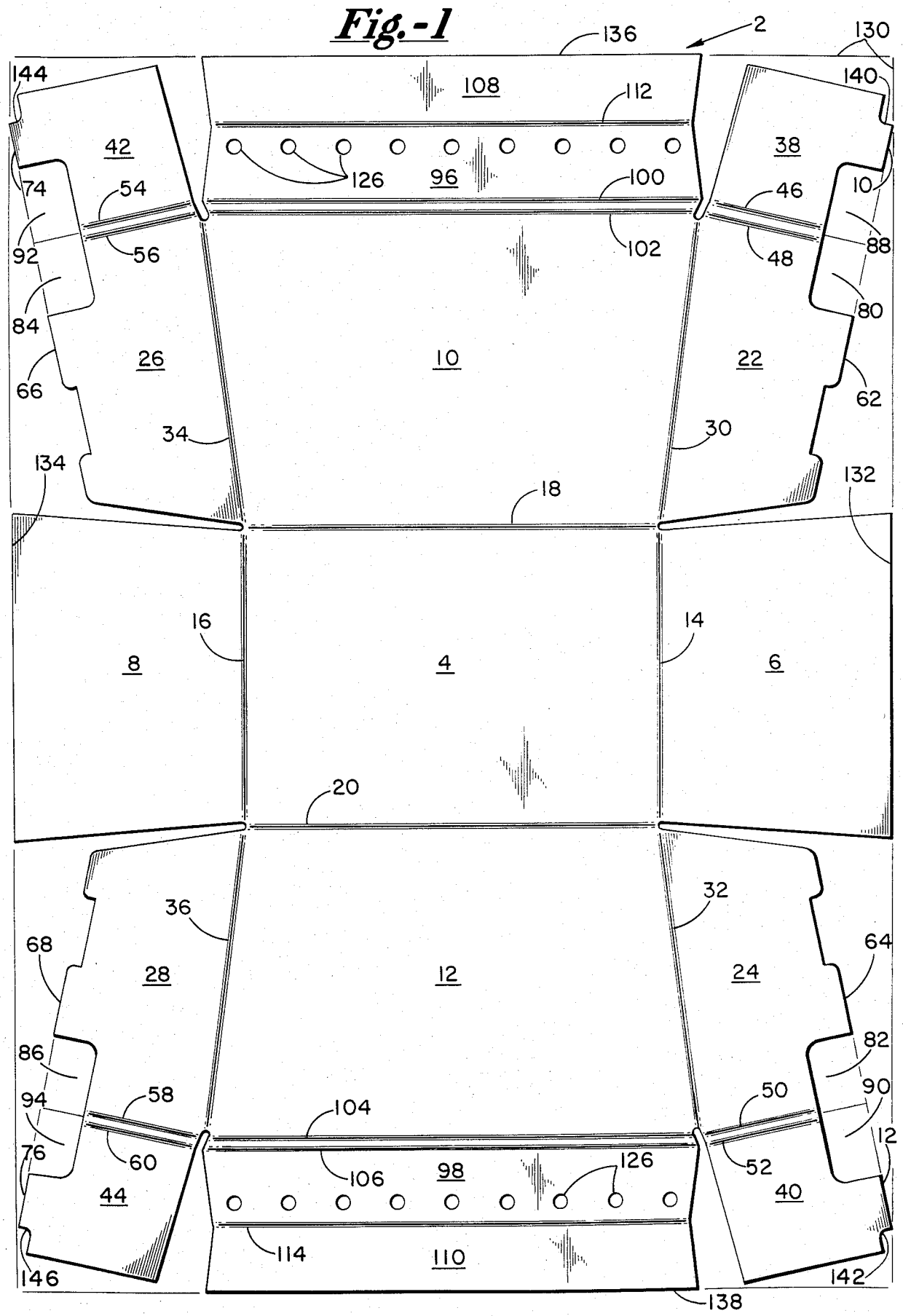
FIG. 1 is a top plan view of the corrugated plastic sheet from which the utility tote container is formed.
Figure 2:
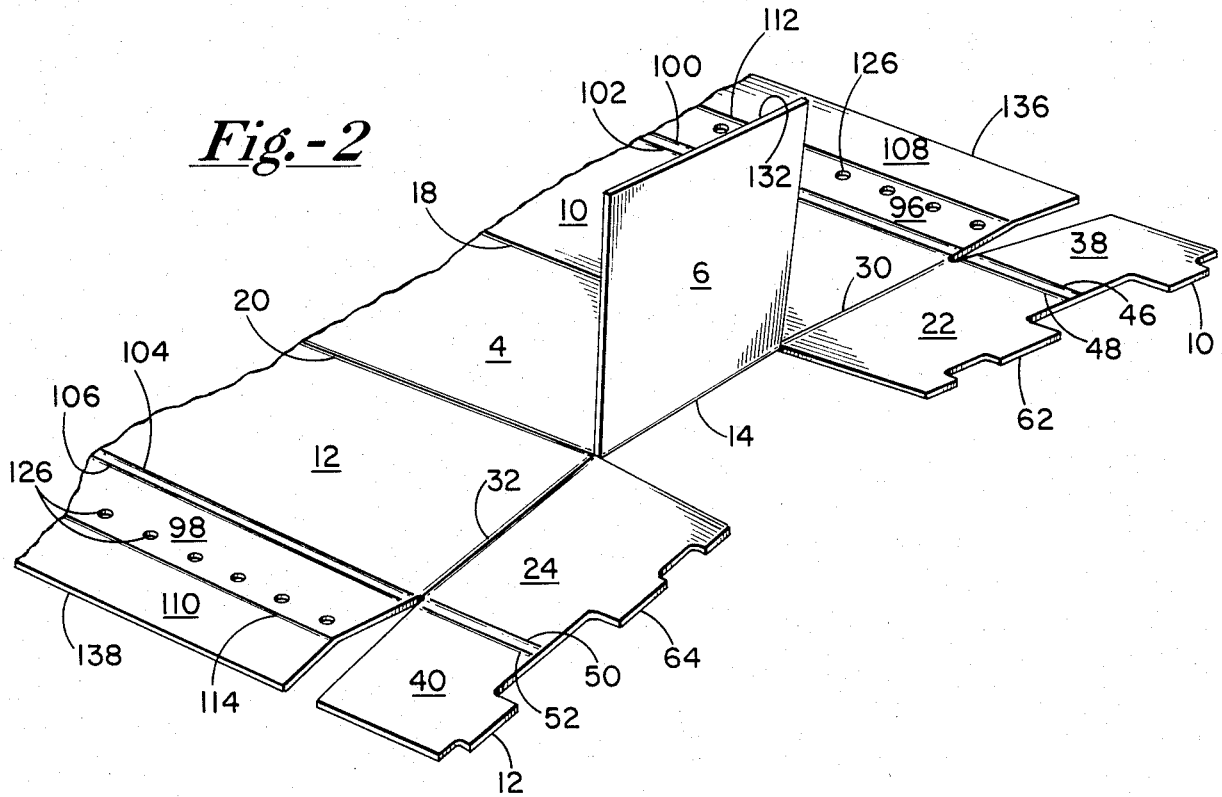
FIG. 2 is a perspective view of the right end portion of the corrugated plastic sheet with the right end wall folded to its upright position.

Referring now to the drawings, I have shown in FIG. 5 a perspective view of the preferred structure of the utility tote container of this invention. The container is generally indicated by reference numeral 1, and is preferably formed from a single sheet of corrugated polyethylene 2 which is precut and scored in the manner shown in FIG. 1. This blank sheet 2 is divided into segments as shown in FIG. 1, the segments separated by score lines, to provide a base platform 4, a right and left end wall 6, 8 and two side walls 10, 12. End walls 6, 8 and side walls 10, 12 are folded upward along score lines 14, 16 and 18, 20, respectively, as shown in FIGS. 2, 3 to form the trapezoidal open top receptacle shown in FIG. 5.

Figure 3:
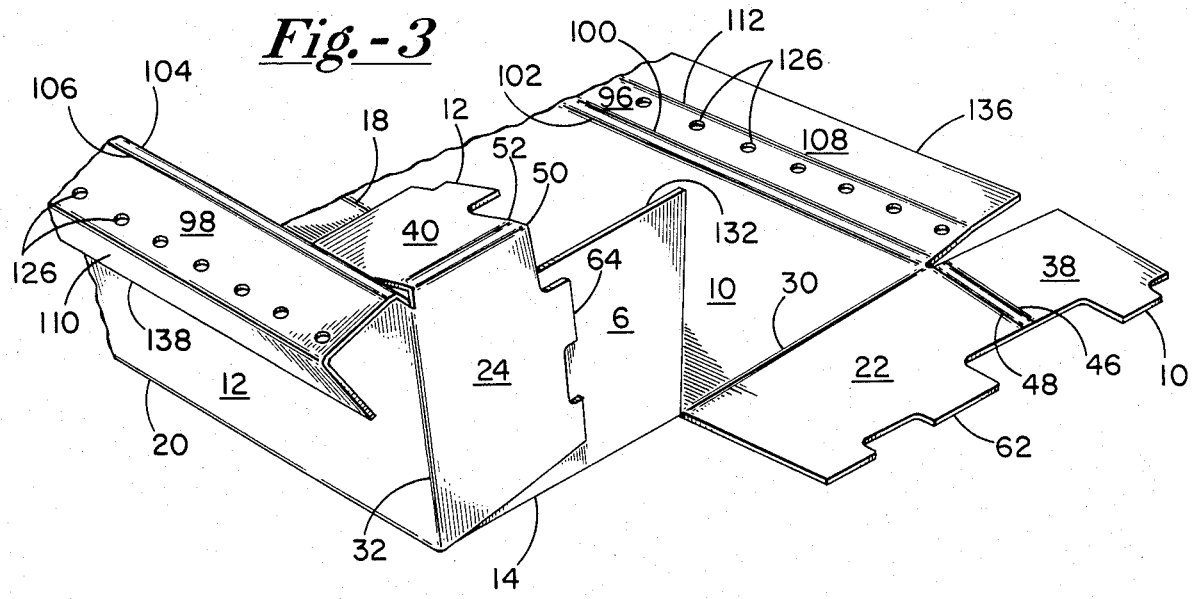
FIG. 3 is a perspective view of the right end portion of the corrugated plastic sheet with the right end wall, front side wall, and right front end panel folded to their upright position, with the right front foldover panel and inner and outer side flaps partially folded downward.

Extending from and hingedly attached to opposite ends of each side wall 10, 12 are a right and left end panel 22, 24 and 26, 28, respectively, which are folded along score lines 30, 32 and 34, 36 inwardly toward the end walls 6, 8 as shown in FIGS. 3, 4. Similarly, extending from the end panels 22, 24, 26, 28 are right and left foldover panels 38, 40 and 42, 44 respectively, which are folded downward along double score lines 46, 48, 50, 52, and 54, 56, 58, 60, respectively, so the surfaces of the foldover panels 38, 40, 42, 44 are parallel to and in contact with the surface of the end walls 6, 8 as shown in FIGS. 3, 4, 5. In the upright folded position the central edges of the right and left end panels 62, 64 and 66, 68 as well as the central edges of the foldover panels 70, 72, 74, 76 are adjacent and parallel to one another. The end panels 22, 24, 26, 28 and end foldover panels 38, 40, 42, 44 may then be fixed or attached to the end walls 6, 8 by using a technique to produce sonic welds 78 as shown in FIG. 5.

Right and left cutaway segments 80, 82, 84, 86 in each end panel and in each foldover panel 88, 90 and 92, 94 are located as shown in FIG. 1 so that when the container 1 is folded to its upright position with the central edges of the end panels 62, 64, 66, 68 and foldover panels 70, 72, 74, 76 adjacent, the cutaway segments 80, 82, 84, 86 and 88, 90, 92, 94 cooperate to form a hand grip opening 122 as shown in FIG. 5.

Outer side flaps 96, 98 extend from the top end of each side wall 10, 12, and are folded downward along double score lines 100, 101 and 104, 106 as shown in FIGS. 3 and 5. Inner side flaps 108, 110 extend from the top of the outer side flaps 96, 98 and are folded upward along score lines 112, 114 so that inner side flaps 108, 110 lie between the outer side flaps 96, 98 and side walls 10, 12. The lower portion of the outer side flaps 96, 98 may best contain a line of multiple apertures 126 through which the inner side flaps 108, 110 and side walls 10, 12 may be fixed or attached together using a technique to produce sonic welds 78 as shown in FIG. 6. The process of folding and attaching the outer side flaps 96, 98 and inner side flaps 108, 110 produces along the lower hinged connection a lower stacking shoulder 128 seen in FIG. 6. By using double score lines along the top of the side walls 100, 102 and 104, 106 a horizontal surface is formed for the upper stacking shoulder 129 which may be wider than the lower stacking shoulder 128. This allows a stable purchase when containers are nested or stacked, as seen in FIG. 8.

When the outer side flaps 96, 98 are folded down, and the inner side flaps 108, 110 are folded up between the outer side flaps 96, 98 and side walls 10, 12 and attached thereto, a pair of side rim pockets 116 are formed, as shown in FIG. 6. Similarly, a pair of end rim pockets 118 shown in FIG. 7 are formed above the side walls 6, 8 when the end panels 22, 24, 26, 28 and end foldover panels 38, 40, 42, 44 are folded together as previously described.

A rigid metal reinforcing rim 120 may be placed within the side rim pockets 116 and end rim pockets 118 to run completely around the perimeter of the top of the container 1. In those portions along the top of the container where the reinforcing rim 120 traverses the region above the hand grip openings 122, a hand grip region 124 is produced as shown in FIG. 5.

The container 1 as herein described may be most economically formed from a blank sheet of material 130 in the shape of a rectangle described and confined by lines whose width is equal to the distance between the outer edges of the end walls 132, 134 and whose length is equal to the distance between the outer edges of inner flaps 136, 138 as shown in FIG. 1. The preferred choice of material for this container 1 is a semi-rigid corrugated polyethylene sheet, cut so the corrugations run linearly and perpendicular to the edges of the inner side flaps 135, 138.

To ensure that the container may be cut from a section of rectangular material as described, notches 140, 142, 144, 146 may be cut in the corners of the end foldover panels 38, 40, 42, 44 to compensate for variations in the dimensions of the container's panels.

We anticipate that various other changes may be made in the size, shape, materials, and construction of the utility tote container herein disclosed without departing from the spirit and scope of the invention defined by the following claims.

What is claimed is:

1. A material handling container comprising:

a receptacle portion formed from a single sheet of semirigid material which is cut, scored, and folded to form a generally rectangular base platform from which a pair of substantially upright opposed side walls and a pair of substantially upright opposed end walls extend, said side and end walls being hingedly connected to said base platform and defining an open top when folded to a generally upright position;

a pair of end panels at each end of said receptacle portion hingedly connected to the opposite ends of each of said side walls along generally vertically extending score line connections, each pair of said end panels being folded over the adjacent one of said end walls in abutting, parallel relation therewith;

a pair of foldover panels at each end of said receptacle portion hingedly connected to the upper ends of each of said end panels along score lines traversing the upper ends of each of said end panels, said foldover panels being folded downwardly and inwardly thereover with the surface of said foldover panels substantially parallel to the surface of said end panels and secured by attachment means to said end walls therebetween;

a pair of outer flaps defined by score lines extending lengthwise of said side walls adjacent the top extremities thereof and hingedly connected thereto, said outer flaps being folded downwardly to form upper stacking shoulders defined by said score lines along the top edges of said side walls; and a pair of inner flaps defined by score lines extending lengthwise of the outer edges of said outer flaps and substantially parallel therewith and hingedly connected thereto, each said inner flap being folded upward between the outer flap to which said inner flap is connected and the adjacent side wall, to form lower stacking shoulders, whereby the lower stacking shoulders rest on said upper stacking shoulders when a plurality of said utility tote containers are nested one inside the other.

2. The utility tote container of claim 1 further comprising:

a plurality of completely cutaway segments in each of said end panels and said foldover panels positioned adjacently along the top edge of said end panels and said foldover panels, said cutaway segments cooperating to form a pair of hand grip openings located at opposing ends of said receptacle portion when said side walls, said end panels, and said foldover panels are folded in a generally upright configuration;

a pair of side rim pockets, bordered and defined by the top of said side walls, said outer flaps, and said inner flaps;

a pair of end rim pockets, bordered and defined by the top of said walls, and between said end panels and foldover panels;

a rigid reinforcing rim of generally rectangular shape contained within said side rim pockets and said end rim pockets, and extending around the top of said container; and a pair of hand grips on opposite ends of said container formed by intermediate portions of said reinforcing rim disposed across the top of said hand grip openings.

3. A container as defined in claim 2 wherein:

said means of attaching said end panels to said end walls, and said foldover panels to said end walls, and said inner flaps to said side walls, is at least one sonic weld.

4. A container as defined in claim 3 wherein:

said outer flaps define at least one aperture which extends through said outer flap in relative spatial proximity to and communicating with said sonic welds.

5. A container as defined in claim 4 wherein:

said sheet of semirigid material is formed from corrugated polyethylene.

6. A container as defined in claim 5 wherein:

the number of score lines defining said upper stacking shoulders along the top edge of each said side wall is two.

7. A container as defined in claim 6 wherein:

said single sheet of semirigid material has a configuration when extended in a single plane so as to be confined by a rectangle whose length is no greater than the distance between the outer edges of said inner side flaps and whose width is no greater than the distance between the outer edges of said end walls.

* * * * *